US006526819B2

(12) United States Patent
Demarchos et al.

(10) Patent No.: US 6,526,819 B2
(45) Date of Patent: Mar. 4, 2003

(54) METHOD FOR ANALYZING A COMPLETION SYSTEM

(75) Inventors: Andronikos S. Demarchos, Houston, TX (US); Johnny Dale Fain, The Woodlands, TX (US); Patrick Charles Hyde, Hurst, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/779,795

(22) Filed: Feb. 8, 2001

(65) Prior Publication Data

US 2002/0166374 A1 Nov. 14, 2002

(51) Int. Cl.[7] ..... E21B 47/00
(52) U.S. Cl. ..... 73/152.01; 73/152.59
(58) Field of Search ..... 73/152.01, 152.59; 166/120, 138, 291, 350

(56) References Cited

U.S. PATENT DOCUMENTS

| | | | | |
|---|---|---|---|---|
| 3,302,714 A | * | 2/1967 | Bearden et al. | 166/291 |
| 3,307,624 A | * | 3/1967 | Lubinski | 166/350 |
| 4,294,318 A | | 10/1981 | Desbrandes et al. | 175/321 |
| 4,382,381 A | * | 5/1983 | Soeiinah | 73/152.01 |
| 4,384,483 A | * | 5/1983 | Dellinger et al. | 73/152.59 |
| 4,508,167 A | * | 4/1985 | Weinberg et al. | 166/120 |
| 4,513,817 A | * | 4/1985 | Weinberg | 166/138 |
| 5,508,915 A | | 4/1996 | Tsao et al. | 364/422 |
| 5,579,844 A | | 12/1996 | Rebardi et al. | 166/296 |
| 5,806,194 A | | 9/1998 | Rodney et al. | 33/304 |
| RE36,012 E | | 12/1998 | Loomis et al. | 250/269.4 |
| 5,978,739 A | | 11/1999 | Stockton | 702/6 |
| RE36,723 E | | 6/2000 | Moore et al. | 166/242.2 |
| 6,105,690 A | | 8/2000 | Biglin, Jr. et al. | 175/48 |

OTHER PUBLICATIONS

Gu, Hongren, et al., "Analysis of Slack–Off Force Transmitted Downhole in Coiled–Tubing Operations," XP–002203518, SPE International, Society of Petroleum Engineers, Inc., 68$^{th}$ Annual Technical Conference, Houston, Texas, Oct. 3–6, 1993, pp. 1–11.

PCT International Search Report from Application PCT/GB02/00296, Dated Jul. 8, 2002.

* cited by examiner

*Primary Examiner*—Hezron Williams
*Assistant Examiner*—Jay L Politzer
(74) *Attorney, Agent, or Firm*—Moser, Patterson & Sheridan, L.L.P.

(57) ABSTRACT

The present invention provides a method for analysing a well completion system, wherein the method includes receiving data representative of physical characteristics of the completion system and calculating a first change in length of a tube string resulting from a helical buckling effect. The method further includes calculating a second change in length of the tube string resulting from a ballooning effect and calculating a third change in length of the tube string resulting from a slackoff force effect. Upon completion of the calculating steps, the method may output predetermined results therefrom.

16 Claims, 4 Drawing Sheets

METHOD FOR ANALYZING A COMPLETION SYSTEM

BACKGROUND OF THE INVENTION

1. Field of the Invention

The present invention generally relates to a system for calculating and analyzing critical stresses in a complex completion tube string.

2. Background of the Related Art

In order to access fluids, e.g., hydrocarbons and/or water from subsurface reservoirs, deep well drilling techniques are typically employed. The drilling and completion portion of these techniques generally includes drilling a borehole in the earth and then lining the borehole with a tubular or "casing" to create a wellbore. The borehole is lined in order to support the walls of the borehole and to facilitate the isolation of certain parts of the wellbore to effectively gather fluids from hydrocarbon-bearing formations therearound. Thereafter, an annular area formed between the casing and the borehole may be filled and sealed with cement. The casing may then be perforated at a predetermined location to permit the inflow of fluid from the formation into the wellbore. Because the casing forming the wellbore is not removable if damaged and because drilling and production fluids are often corrosive, a separate, smaller diameter string of tubulars or production tubing is typically inserted coaxially into the wellbore to provide a conduit to the surface for production fluid. The tubing string may include and/or have attached thereto, some length of wellscreen at a lower end whereby production fluid may enter the string while particulate matter carried by the fluid, like formation sand, is filtered out.

To urge the fluids into the production string, an annulus may be formed between the production string and the casing may be sealed with packers above and below the perforated area of the casing. Various types of packers are in use today and their basic functions and operation are well known to those skilled in the art. In general, a packer fits in an annular area between two tubulars and prevents fluids from passing thereby. In the case of a production string within a wellbore, the packer seals the annulus formed between the production string and the casing, thereby preventing the production fluid from traveling to the surface of the well in the annulus. Packers are typically carried into a wellbore on production tubing or some separate run-in string and then remotely actuated with some type of expandable element extending radially outward to contact and seal the casing. In each case, the packer relies on a sealing assembly between the inside diameter of the packer and the outside diameter of the production tubing.

A traditional wellbore may include a string of production tubing several thousand feet in length. The length of the string sections results in enormous weight, at least some of which must be supported in order to prevent the string from buckling and becoming damaged in the wellbore. While the diameter of the tubing is relatively small, the great length of these stings of pipe exaggerates any pressure and/or thermal conditions that are preset in the wellbore. For example, temperatures at the bottom of a wellbore are typically higher than temperatures at the surface of the well. Therefore, the overall length of a production string can increase significantly as a result of these pressure differences. Due to thermal expansion, conversely, in some well treatment programs, relatively cool fluids are pumped in and around a production string of tubulars and the overall length of the string can actually decrease in these instances. Similarly, differences in pressures may also cause a tube string to either expand or contract, depending upon the situation.

A change in the length of production strings is especially critical to the operation of packers. Because packers rely upon an interaction of sealing members on the tubing and the packer, any axial movement of the tubing with respect to the packer can cause the sealing members to lose contact with one another and the packer to become ineffective. In some cases, tubing is supplied with extended sealing surfaces to compensate for expected tubing string movement due to thermal expansion and contraction. However, these remedies are not always effective if the conditions of the well are such that a change in tubing length is unforeseen or is greater than expected. Therefore, prior to implementing a completion system, often the physical characteristics of the tube string are analyzed in order to accurately determine the forces that may be acting on the tube string during operation. This analysis may then be used to modify the design of the tube string in order to reduce the possibility of breaking and/or buckling as a result of excessive stresses on the tube string.

The basic application of mathematical principles for calculation and analysis of forces in single string completion systems was presented by Lubinski, Althouse, & Logan in a paper entitled "Helical Buckling of Tubing Sealed in Packers" in October of 1961. Although Lubinski clearly addressed the basic linear mathematical equations and procedures necessary to analyze the single string completions of the 1960's, the drilling industry quickly progressed past simple single string completions into more complex combination-type completion systems. Stress analysis work was also postulated by Durham in a paper entitled "Tubing Movement, Forces, and Stresses in Dual Flow Assembly Installations" in 1980. Therefore, in an attempt to analyze these combination-type completion systems, Hammerlindl published an article entitled "Movement, Forces, and Stresses Associated with Combination Tubing Strings Sealed in Packers" in 1977, which was essentially an analytical "extension" of the linear single string principles espoused by Lubinski. As a result of Hammerlindl's "extension" approach to combination-type completion systems, the tenets of Lubinski were applied to combination systems, which resulted in inaccurate analysis of complex completion systems.

As an example of a possible inaccuracy in Hammerlindl's extension-type principles, consider application of a linear single-string completion analysis to a complex completion system, such as the exemplary system shown in FIG. 2, for the purpose of determining the change in length of the tube string due to a ballooning effect through linear superposition techniques. In calculating the change in length using Hammerlindl's method, the change in length for each section is calculated and the sum of the individual calculations are added together to generate a solution for the entire complex tube string. The equation for calculating the change in length is shown below as equation (1).

$$\Delta L_3 = \frac{VL^2}{E}\frac{\Delta\rho_t - R^2\Delta\rho_c - \frac{1+2\nu}{2\nu}\delta}{R^2-1} - \frac{2\nu L}{E}\frac{\Delta P_t - R^2\Delta P_c}{R_2-1} \tag{1}$$

However, upon careful consideration of the application of the superposition principle to equation (1), Applicants submit that the result obtained by Hammerlindl may not be 100% accurate in all situations. For example, Applicants submit that the calculation method of Hammerlindl does not consider the state of the tube string in the calculation, and therefore, if the state of the tube string is not as Hammerlindl assumes, an inaccurate result may be obtained.

Similar examples may be found in Hammerlindl's application of Lubinski's analytical theory to complex completion systems with regard to the calculation of buoyancy effects, the calculation of buckling effects, and the calculation of the slack off forces reaching a packer in a situation where the tube string is in contact with the casing at one or more locations in the well bore. Therefore, in view of these deficiencies, there exists a clear need for a completion systems tube string analysis system and/or method capable of accurately analyzing modem complex completion systems.

SUMMARY OF THE INVENTION

The present invention provides a method for analysing a well completion system, wherein the method includes receiving data representative of physical characteristics of the completion system and calculating a first change in length of a tube string resulting from a helical buckling effect. The method further includes calculating a second change in length of the tube string resulting from a ballooning effect and calculating a third change in length of the tube string resulting from a slackoff force effect. Upon completion of the calculating steps, the method may output predetermined results therefrom.

The present invention further provides a method for analysing a well completion system, wherein the method includes receiving input data representative of physical and environmental characteristics of the completion system and determining a change in length for each individual tube section of a tube string. The method further includes determining a total change in length of the tube string through summing the change in length determined for each individual tube section of the tube string, and outputting results of the determining step to the user.

The present invention further provides a signal-bearing medium having a completion system analysis program thereon. When one or more processors execute the program, a method for analysing a completion system is undertaken. The analysis method includes receiving data representative of physical characteristics of the completion system, and calculating a first change in length of a tube string resulting from a helical buckling effect. The method further includes calculating a second change in length of the tube string resulting from a ballooning effect and calculating a third change in length of the tube string resulting from a slackoff force effect. The results of the calculating steps, or at least predetermined portions thereof, may be outputted and/or displayed to a user.

The present invention further provides a signal-bearing medium containing a program for analysing a completion system that when executed by a processor performs a method for analysing characteristics of a completion system. The method may include the steps of receiving input data representative of physical and environmental characteristics of the completion system, determining a change in length for each individual tube section of a tube string, and determining a total change in length of the tube string through summing the change in length determined for each individual tube section of the tube string. Once these steps are conducted, the method may include the step of outputting results of the determining steps to the user.

BRIEF DESCRIPTION OF THE DRAWINGS

So that the manner in which the above recited features, advantages and objects of the present invention are obtained can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments not expressly shown herein.

DETAILED DESCRIPTION OF THE PREFERRED EMBODIMENT

In order for a complex completion system to successfully perform, the physical characteristics of the completion system must be properly selected through careful analysis of the physical and environmental factors affecting the completion system during operation. A complete and thorough analysis considers factors such as time dependant well conditions, resultant forces, and changes in tubing properties, specifically tube length, during operation. This type of analysis is generally undertaken prior to installation of the completion system, so that modifications and/or corrections may be made to the system in order to avoid system failure subsequent to installation. However, current completion systems may be configured with sensors for monitoring physical conditions of the tube string and the surrounding environment in order to support analysis of the tube string during operation.

The present invention provides a method for analyzing complex completion systems, wherein the analysis is generally executed by computer software or through alternative processing devices. As such, the operating instructions for executing the analysis method of the present invention may be stored on a computer readable medium, and later retrieved and executed by a processing device. The inputs, calculations, and user displays of the analysis may be received, processed, and presented to the user through publicly available software packages, such as Microsoft Excel®, a spreadsheet based program created by Microsoft Corporation of Redmond, Wash., or through other data processing-type software packages capable of executing the method of the present invention.

Figure 1:
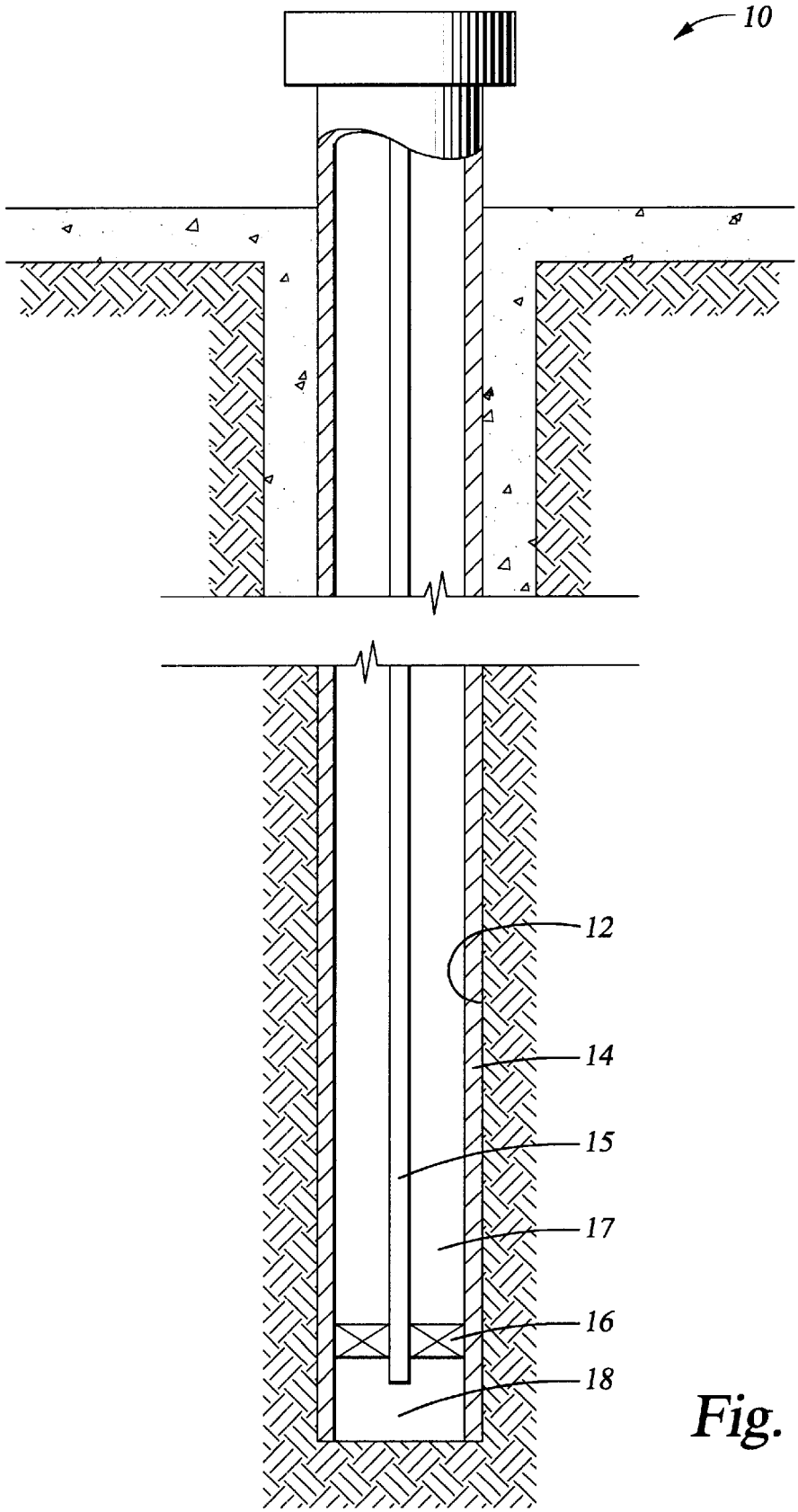
FIG. 1 illustrates tube string with a single packer.
Figure 2:
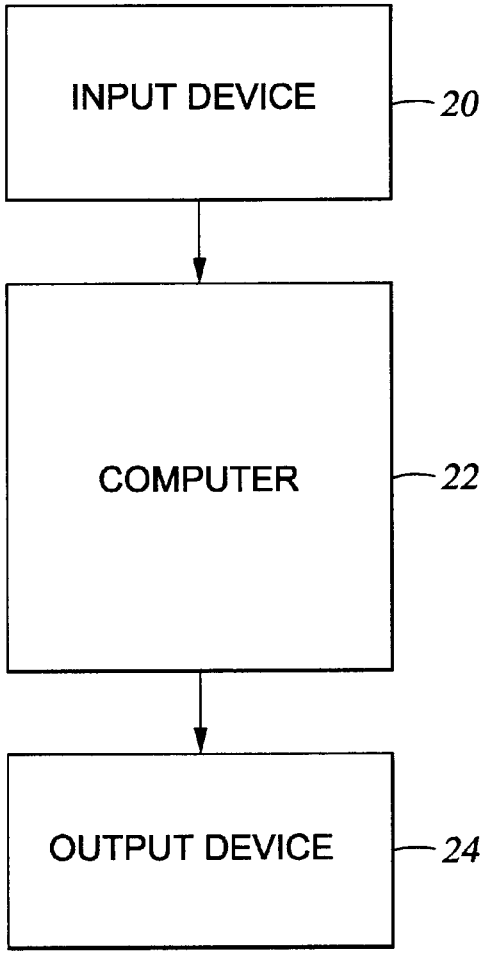
FIG. 2 illustrates an exemplary hardware configuration of the present invention.

An exemplary hardware configuration for implementing the present invention is illustrated in FIG. 2. Input device 20 may be used to receive and/or accept input representing basic physical characteristics of a complex completion system and a well. These basic characteristics may be dimensions, temperatures, densities, pressures, applied forces, equipment types, etc. This information is transmitted to a processing device, which is shown as computer 22 in the exemplary hardware configuration. Computer 22 processes the input information through selected mathematical algorithms in order to calculate the operational parameters of the complex completion system. Upon completing the data processing, computer 22 outputs the resulting information to output device 24, which may operate to display the results of the calculations to the user. Common output devices used with computers that may be suitable for use with the present invention include monitors, digital displays, printing devices. Alternatively, the output device may be configured to operate as a controller for the completion system, which could then alter a physical condition of the completion system in response to analysis of the system. For example, if analysis of the completion system determines that a critical stress and/or force is being generated in the tube string, then the output device may be configured to control a mechanical device configured to alter a characteristic of the tube string in order to avoid the critical stress and/or force.

Alternatively, upon reviewing the output information from output device 24, if the user determines that a particular parameter is likely to cause failure of the completion system, then the user may modify selected input information in order to determine if the particular parameter will be altered to a condition that is determined not likely to cause failure of the system. For example, if the output information indicates that a tube string is likely to linearly expand to a critical stress level as a result of the temperature change in the well bore, then the user may modify the dimensions of the tube string and reprocess the input data. If the critical stress is lowered to an acceptable level, then a design change in the completion system can be made prior to installation. Alternatively, if the completion system is already installed, downhole changes may be made to the system in order to avoid a complete failure. Further, the data processing portion of the present invention may be configured to indicate to the user what parameters may be changed in order to alter a critical parameter to an acceptable level through an input variable—resultant output analysis.

Figure 3:
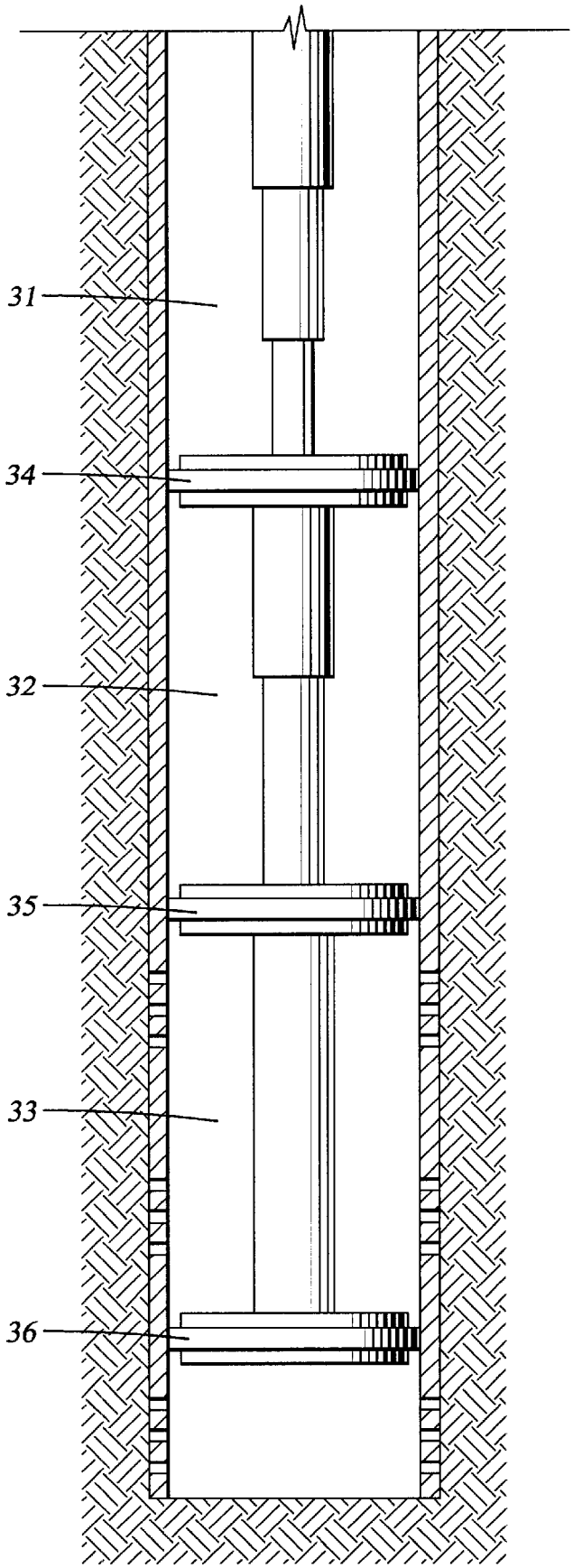
FIG. 3 illustrates a complex tube string.

A well bore schematic illustrating an exemplary complex completion system that may be analyzed by the present invention is shown in FIG. 3. Although FIG. 3 shows a multiple string 31, 32, 33—multiple packer system 34, 35, 36, single and double string completions may also be analyzed by the present invention. For example, if a single string system is implemented, then only data for the upper packer 34 and the top tubing section 31 would be inputted into the analysis. Similarly, if a two string—two packer system was used, then only the upper two strings 31, 32 would be entered. Therefore, various combinations of strings and packer configurations may be analyzed by the present invention.

As generally discussed above, prior to any calculation and or analysis of a completion system, a number of general parameters corresponding to the physical characteristics of the completion system and the environmental conditions of the well bore must be inputted. These parameters may include the following:

Initial Surface Temperature—the temperature just below surface where the value remains stable over time (does not change with outdoor ambient conditions). In the case of a low fluid level well, temperature of the well bore fluid should be used if the level is near the surface, and ambient air temperature should be used if the fluid level is low on the string. In the case of multiple packers, well bore fluid temperature nearest the surface is used.

Initial Bottom Hole Temperature—temperature of the well bore fluid at the packer when the packer is set. In the case of multiple packers, use well bore fluid temperature at the lowest packer to be set. This temperature will generally be modified during the calculation phase when dealing with calculations relative to upper packers. The modifications will generally involve calculating a temperature gradient along the well bore, acting under the assumption that there is a linear temperature change along the well bore.

Final Surface Temperature—temperature of the well bore fluid at the surface when the operation under consideration is complete. This may be a produced or injected fluid temperature. However, the value should reflect the temperature of the tubulars at the surface.

Final Bottom Hole Temperature—temperature of the well bore fluid at the bottom packer when the operation under consideration is complete.

Depth of BHT (MD)—measured depth at which both of the bottom hole temperatures were taken.

Depth of BHT (TVD)—true vertical depth at which both bottom hole temperatures were taken. This value is generally used to calculate the temperature gradient, which is later used to calculate the temperature at each section of tubing and at each packer based on the TVD of each respective element. Although typical analysis systems generally use MD for the gradient calculation, erroneous gradient calculations may result for highly deviated wells, and therefore, TVD is the most accurate basis for calculating gradient.

Initial Tubing Fluid—density of the fluid in the tubing when the packer was run, the density being entered in units of pounds per gallon. initial Tubing Fluid Level—if the packer is set in a low fluid level well, hydrostatic pressure is affected.

Initial Casing Fluid—density of the fluid in the casing when the packer was run, the density being entered in units of pounds per gallon. This is often the same as the fluid in the tubing, however packer fluid could be circulated into the annulus prior to setting the packer.

Initial Casing Fluid Level—if the packer is set in a low fluid level well, hydrostatic pressure and potentially the temperature may be affected. To balance a tubing fluid of different density, the fluid level in the casing may be at a different level (as opposed to applying pressure to tubing or annulus to balance). The tubing and casing fluid density and fluid level are used to calculate hydrostatic pressure conditions at each tubing section and at the packer to obtain the total pressure, when added to the applied pressure. The inputted fluid levels are also used to calculate the string weight in fluid.

Coefficient of Thermal Expansion—this coefficient defines the linear relationship between the change in average tubing temperature and the change in tubing length. The coefficients are constant for particular tubing compositions, but must be entered into the program. For steel tubing, for example, the coefficient of linear expansion is 0.0000069 inches per degree in temperature change in Fahrenheit.

Poisson's Ratio—When tubular members manufactured from generally homogeneous materials remain in the elastic range, there exists a proportionality between the lateral and axial strains on the tubular member that was first demonstrated by Poisson. This proportionality is generally defined and/or known for homogenous materials, but must be inputted in order to calculate the forces and strains on the particular tubulars of the completion system. For steel, which is often used for tubulars in completion systems, Poisson's ratio is equal to 0.30 and is dimensionless.

Tubing Pressure Initial—the pressure applied to the tubing at the surface under initial conditions. This pressure may be applied to balance well bore fluid or to set a packer.

Casing Pressure Initial—the pressure applied to the annulus at the surface under initial conditions.

Wireline Tool Diameter to Pass—when tubulars are subjected to helical buckling, it is often difficult to pass wireline-type or other service tools through the helix. The diameter of future logging or perforating tools is often known prior to running the completion. Therefore, since most tubulars experience some degree of helical buckling, there is a calculation that determines the maximum length of a solid tool of this given diameter that can pass through the helix in the tubular member.

Number of Packers—the number of packers used on the completion system.

Depth (MD)—the measured depth at which a packer was set. This value should be identical to the MD of tubing for the respective packer.

Depth (TVD)—true vertical depth at which a packer was set. This value will generally be identical to the TVD of tubing for the respective packer.

Packer Type—this reflects the type of attachment between the upper tubing string or seals and the packer. Three types of attachment are expressly considered by the calculations of the present invention: 1) Free: the seal assembly has no mechanical means of applying a load to the packer. The seal assembly, and thus the bottom of the tubing string, is free to move axially within the packer bore. This type of packer generally cannot sustain tubing to packer load other than seal friction. 2) Landed: the seal assembly has a locator that allows tubing weight to be "set down" on the packer, while the tubing is free to move in the upward direction. As such, compressive load may generally pass from the tube string to the packer, while tensile load cannot. Therefore, the string is essentially free to move downward in the packer until the locator "lands" on the packer. At this point, any attempt to apply further downward motion generally results in application of compressive force to the packer. Upward motion is permitted without restriction once the string is picked up off of the bottom. 3) Anchored: the seal assembly has a device to fix the bottom of the tubing string to the packer, and therefore, axial motion of the tubing generally not permitted. Any axial movement results in the application of tensile or compressive forces to the bottom of the packer.

Packer Seal Bore or Valve Diameter—is the honed bore inside the packer where the seal assembly seals. When the seal assembly is run inside the packer, pressure acts on the bottom of the tube string at the seal bore diameter. On a mechanical type tool, a bypass valve area is entered here.

Slackoff or Pickup Force—when the packer is set, tubing weight can either be slacked-off or picked-up from the packer, assuming that the packer is of the type that allows such axial movement. Therefore, following sign convention, weight slacked-off is a positive slackoff force and weight picked-up is a negative force.

Tubing Fluid Final—density of the fluid, gases included, inside the tubing in units of pounds per gallon.

Casing Fluid Final—is the density of the fluid or gas in the annular area between the tubing OD and the casing ID.

Tubing Pressure Final—the surface pressure applied to or induced within the tubing. Generally this value is represented by a pressure gage at the surface attached to the tubing end.

Casing Pressure Final—the surface pressure applied to the annulus in the case of the upper packer, and for subsequent packers, the value would be the pressure that would be measured on a gage at the top of that particular section's annular area just below the next higher packer.

Number of Tubing Sections—Three tubing sections are possible for each packer. The number of sections of tubing for the particular application in inputted into the calculation.

Tubing Outside Diameter (OD)—for each individual tubing section.

Tubing Inside Diameter (ID)—for each individual tubing section.

Tubing Weight—the actual weight of the tubing in a particular section, including couplings, where the measurement is in pounds per foot.

Tubing Yield Strength—is a mechanical property of the tubing that specifies a minimum yield strength. Yield strength is defined as a point at or near which stress is no longer proportional to strain in a tubing section, and as such, the material is no longer elastic. Therefore, any further load results in permanent deformation of the tube. For API type tubulars, yield strength is designated as a grade; for example, N-80 tubing has a yield strength of 80,000 PSI, while P-110 tubing has a yield strength of 110,000 PSI.

Measured Depth to Bottom of Section—is the actual length of tubing used to make up a particular section.

TVD to Bottom of Section—when run in the well, the bottom of this particular section resides at the previously noted true vertical depth.

Casing ID—is the inside diameter of the casing within which the tubing resides.

Once the necessary initial parameters are inputted, a series of calculations relative to the critical forces and stresses of the particular completion system may be undertaken. Although the calculations are termed a "series", each calculation may or may not be used in determining another portion of the series of calculations. Therefore, the only requirement for sequencing of the calculations is that all equations contributing to a particular equation are generally solved prior to solving the particular equation, and therefore, the term "series" does imply that the following calculation must be executed in any particular order.

The first series of calculations is generally used to calculate the moment of inertia of a particular section of tubing, and moment of inertia is a basic parameter in most tube strength and stress calculations. In particular, when bending forces are present in a tube section, such as the bending forces resulting from helical buckling, the moment of inertia is used to define the tubing section property over which the force is dispersed. Moment of inertia for a tube section may generally be calculated through equation (2), wherein y represents the distance from a neutral axis to a tubing cross section carrying the load and dA represents an integral cross section of area.

$$I = \int y^2 dA \tag{2}$$

Further, for circular tubing having a concentric inner diameter, wherein the center of the tubing is the neutral axis, equation (3) defines the moment of inertia where $OD_t$ and $ID_t$ are user inputs noted above.

$$I = \frac{\pi}{64}(OD_t^4 - ID_t^4) \tag{3}$$

With the basic moment of inertia calculations completed, the next series of calculations are generally termed length, area, and clearance calculations. The first of this series of calculations is a calculation of the tubing length, which is entered as the MD to the top and bottom of a particular section. Therefore, in order to determine the length of a particular tubing section, the difference in MD is taken and then multiplied by 12 in order to convert the result into inches, as lengths in inches are used purely for continuity of units throughout the remaining calculations. Therefore, the length of a tubing section (L) is shown in equation (4), wherein $MD_t$ is a user input noted above for measured depth. Further, the variables ID and OD as used herein represent the inside diameter and outside diameter of the respective part indicated by the following subscript, wherein subscript c indicates casing, subscript t indicates tubing, wt represents wireline, and s represents the seal.

$$L=(MD_{t(n)}-MD_{t(n-1)})12 \tag{4}$$

The cross sectional area is also calculated, as shown by equation (5).

$$A_s = \frac{\pi}{4}(OD_t^2 - ID_t^2) \tag{5}$$

The cross sectional area between the tubing outside diameter and the casing inside diameter is calculated as shown in equation (6).

$$A_a = \frac{\pi}{4}(ID_c^2 - OD_t^2) \tag{6}$$

The radial distance from the outside diameter of the tubing to the inside diameter of the casing is calculated as shown in equation (7).

$$r = \frac{(ID_c - OD_t)}{2} \tag{7}$$

A first total end area of the tube string, often termed the outside area of the tube string, is calculated using the outside diameter ($OD_t$), as shown in equation (8).

$$A_o = \frac{\pi}{4}(OD_t^2) \tag{8}$$

A second total end area of the tube string, often termed the inside area of the tube string, is calculated using the inside diameter ($ID_t$), as shown in equation (9).

$$A_i = \frac{\pi}{4}(ID_t^2) \tag{9}$$

With the tube areas calculated, the calculation of hydraulic forces acting on the tubing at the packer seal bore are next addresses. These forces are directly proportional to the area of the seal bore and end of the tubing at the packer. Additionally the hydraulic forces at the packer seal are also dependent upon the total pressure, which will be calculated later. Since the primary region of interest is at the respective packer, it generally does not matter how many sections of tubing are above the packer for purposes of the hydraulic force calculations, as the area of interest for these particular calculations is only the area immediate the packer. The packer to casing or bore seal area is calculated from equation (10).

$$A_p = \frac{\pi}{4}(ID_s^2) \tag{10}$$

The seal bore to tubing ID area is calculated, as the internal tubing pressure acts on an area from the seal bore inside diameter to the inside diameter of the tubing. This seal bore to tubing area calculation, which is represented by equation (11) is later used in calculating the hydraulic piston force.

$$A_{ts} = \frac{\pi}{4}(ID_s^2 - ID_t^2) \tag{11}$$

The seal bore to tubing outside diameter is also calculated, as shown in equation (12). The seal bore to tubing outside diameter is also used later to calculate the hydraulic piston force, as annular casing pressure acting upon the area from the seal bore inside diameter to the seal bore outside diameter is a variable in the calculation of hydraulic piston force.

$$A_{TS} = \frac{\pi}{4}(ID_s^2 - OD_t^2) \tag{12}$$

In addition the area calculations, the true vertical depth of the tubing too section must also be determined. In particular, in order to accurately calculate temperature and hydrostatic pressure gradients, the true vertical location of each tube section must be defined. In order to define these parameters, the assumption is made that the TVD of the top of the first section of tubing is zero feet below the ground surface. The TVD of the bottom of that particular section is an input noted above, and therefore, basic addition and subtraction operations can be used to determine the TVD of each section.

The next series of calculations are primarily temperature-related calculations. The calculations include an initial and final temperature calculation for each section of tubing and at each of the one to three packers. The temperature calculations will later be used to calculate the change in length of the tube string as a result of linear thermal expansion. In progressing through the temperature calculations, it is generally assumed that the temperature increases or decreases linearly with depth of the well bore. Therefore, in order to determine temperature parameters, a temperature gradient must be established, and in particular, a gradient should be established in terms of temperature change in degrees Fahrenheit per linear foot of TVD. It should be noted that the TVD is used for these calculations, as opposed to the linear length of the tubing string, as the gradient calculation may be highly susceptible to error if linear length of tubing is used for gradient calculations when a well is highly deviated in orientation.

The initial temperature gradient is calculated as shown in equation (13), wherein $\nabla Ti$ represents the initial temperature gradient in degrees Fahrenheit per linear foot, $T_{BH}$ represents the initial bottom hole temperature in degrees Fahrenheit, Tsi represents the initial surface temperature, and $TVD_{BHT}$ represents the true vertical depth at which BHT was measured in feet.

$$\nabla T_i = \frac{T_{BHi} - T_{Si}}{TVD_{BHT}} \tag{13}$$

The final gradient, represented by $\nabla T_f$, is calculated by equation (14), wherein subscript $T_{sf}$ represents the temperature at the surface.

$$\nabla T_f = \frac{T_{BHf} - T_{Sf}}{TVD_{BHT}} \tag{14}$$

The initial temperature at the top of the particular section is represented by equation (15), wherein $T_{TOTi}$ represents the initial temperature at the to of a section, $T_{Sf}$ represents the final surface temperature, and $T_{SURFi}$ represents the initial surface temperature.

$$T_{TOPi}=(TVD_{top}\times\nabla T_i)+T_{SURFi} \tag{15}$$

The initial temperature at the bottom of the particular section is represented by equation (16), wherein $T_{BOTi}$ represents the initial bottom hole temperature.

$$T_{BOTi}=(TVD_{bot}\times\nabla T_i)+T_{SURFi} \tag{16}$$

With the gradient and initial and final temperatures determined, the average initial temperature of the tubing is calculated. This calculation contributes to the subsequent calculations relating to tubing length change and force change, as both of these calculations are based upon the average initial tubing temperature. The average initial tubing temperature is calculated by equation (17), wherein the variable T represents temperature and the subscripts AVGi, TOPi, and BOTi represent initial average, top average, and bottom average respectively.

$$T_{AVGi} = \frac{T_{TOPi} + T_{BOTi}}{2} \tag{17}$$

The final tubing temperature at the top of a particular section, defined by the subscript TOPf, is calculated through equation (18), where the subscripts top and Sf represent the depth at the top of the particular tube section and the final temperature of the tube section respectively.

$$T_{TOPf}=(TVD_{top}\times\nabla T_f)+T_{Sf} \tag{18}$$

The corresponding final tubing temperature at the bottom of a particular section is calculated in equation (19), wherein the subscript bot represents bottom.

$$T_{BOTf}=(TVD_{bot}\times\nabla T_f)+T_{Sf} \tag{19}$$

With the top and bottom temperatures for a particular tubing section calculated, the average final tubing temperature can be calculated, as shown in equation (20).

$$T_{AVGf} = \frac{T_{TOPf} + T_{BOTf}}{2} \tag{20}$$

Further, with the average final tubing temperature calculated, the change in average tubing temperature (dT) can be calculated, as shown in equation (21).

$$dT=(T_{AVGf}-T_{AVGi}) \tag{21}$$

The change in tubing temperature is used to calculate the length change due to temperature change (ΔL4) for each tube section, as shown in equation (22). This length change calculation, along with each of the previously illustrated variables that are required to calculate the result of equation (22), are calculated for each individual tubing section. Therefore, the series of calculations resulting in the calculated change in length for a particular tubing section may be undertaken several times in order to calculate the change in length for each section of a completion system.

$$\Delta L_4=\alpha L\,dT \tag{22}$$

Therefore, the process of calculating the change in length as a result of temperature changes for a completion system begins with inputting the values for temperature at the surface and at predetermined depths in the well bore, which establishes initial conditions. These conditions combined with the true vertical depth allow for the calculation of temperature gradient. The temperature gradient is then used in conjunction with the true vertical depth of the top and bottom of each individual tube section to calculate the temperature at the top and bottom of each section under initial and final conditions. These values are averaged to determine an average tube section temperature, and subtracted to get a temperature difference, which is then used to calculate a change in length due to the difference in temperature. The change in length as a result of a temperature differential is dependent upon a constant, the coefficient of linear expansion for the particular material used to manufacture the tube sections, which is represented by a in equation (22).

With the temperature dependent length change calculations complete, the next series of calculations generally relates to pressure calculations. A number of the following pressure related calculations depend on the actual state of the pressure throughout the completion system. Total pressure is defined as pressure applied pressure that can be measured by a gage installed at the top of a fluid column and hydrostatic pressure is defined as pressure that is induced by the weight of a column of fluid at a particular depth.

With these definitions in mind, under initial conditions fluids may not completely fill the well bore. Therefore, to account the lower than surface fluid level, the input value of initial tubing fluid level and initial casing fluid level are used. Therefore, using these values, the initial and final hydrostatic pressures in the tubing are calculated in accordance with equations (23) and (24), wherein $H_{ti}$ represents the hydrostatic pressure in the tubing, $\rho_{ti}$ represents the initial density of the fluid in the tubing, and $\rho_{ci}$ represents the initial density of the fluid in the casing.

$$H_{ti}=(0.052)(\rho_{ti})(TVD-TFL_i) \tag{23}$$

$$H_{ci}=(0.052)(\rho_{ci})(TVD-CFL_i) \tag{24}$$

With the initial conditions calculated, a general hydrostatic final pressure in the tubing may be determined through equation (25).

$$H_{tf}=(0.052)(\rho_{tf})(TVD) \tag{25}$$

In view of the current practice in the drilling industry to utilize fluids of varying densities within sections of a tube string between packers, equations (26), (27), and (28) may be used to calculate hydrostatic pressure in each of the respective tube sections 1, 2, and 3.

$$H_{tf}=(0.052)(\rho_{tf1})(TVD_1) \tag{26}$$

$$H_{tf2}=(0.052)(\rho_{tf2})(TVD_2-TVD_1)+H_{tf1} \tag{27}$$

$$H_{tf3}=(0.052)(\rho_{tf3})(TVD_3-TVD_2)+H_{tf2} \tag{28}$$

Under final conditions, the casing fluid is assumed to completely fill the well bore. However, when multiple packers are set in the completion system, it may be assumed that none of the packers suffer from pressure and/or fluid throughput leaks. Further, it may be assumed that the actions involved in setting, for example, an upper packer, isolates the second tube string section from hydrostatic pressure in the upper string's annular area. Further, if a second packer is set, then it is assumed that the hydrostatic pressure in the annulus just below the second packer is zero, as the upper packer's element system isolates the lower annular area from fluid in the upper annular area. Using these assumptions, the hydrostatic pressure in the casing is defined by equations (29), (30), and (31), wherein the subscripts cf1, cf2, and cf3 indicate the top, middle, and bottom packers at a final condition.

$$H_{cf1}=(0.052)(\rho_{cf1})(TVD_{BOT1}) \quad (29)$$

$$H_{cf2}=(0.052)(\rho_{cf2})(TVD_{BOT2}-TVD_{BOT1}) \quad (30)$$

$$H_{cf3}=(0.052)(\rho_{cf3})(TVD_{BOT3}-TVD_{BOT2}) \quad (31)$$

In this series of calculations, it should be noted that calculations are undertaken for the hydrostatic pressure at the bottom of each tubing section, as well as at each packer on the tube string. Further, the above noted assumption that the contribution of initial annular hydrostatic pressure at the top of a section is zero over time may not be applicable in every situation where multiple packers are installed.

With the hydrostatic pressure for each element defined, the total pressure, which is the hydrostatic pressure added to the total initial pressure, may be calculated. The total initial pressure inside a tube section may be calculated through equation (32), wherein the subscript TI(n) represents the total pressure at initial conditions at depth for section (n) and pi(n) represents initial condition in the tubing section (n) for both pressure and hydrostatic pressure.

$$P_{TI(n)}=H_{ti(n)}+P_{ti(n)} \quad (32)$$

The total initial pressure inside the casing is then calculated through equation (33), wherein the subscripts CI(n) and ci(n) represent the total pressure and hydrostatic pressure in the casing at depth at initial conditions.

$$P_{CI(n)}=H_{ci(n)}+P_{ci(n)} \quad (33)$$

The total final pressure inside the tubing is then calculated through equation (34), wherein the subscripts TF(n) and tf(n) represent the total pressure and hydrostatic pressure in the tubing at depth at final conditions.

$$P_{TF(n)}=H_{tf(n)}+P_{tf(n)} \quad (34)$$

The total final pressure inside the casing is then calculated through equation (35), wherein the subscripts CF(n) and cf(n) represent the total pressure and hydrostatic pressure in the casing at depth at final conditions.

$$P_{CF(n)}=H_{cf(n)}+P_{cf(n)} \quad (35)$$

With the initial and final pressures for both the tube sections and the casing calculated, the next series of calculations relate to the calculation of the pressure differential across the respective packers. This pressure differential is defined as the difference in pressure across the packer's sealing system to the casing, and is not synonymous with the pressure differential across the tubing just above the packer. In the case of a single packer, the pressure differential across that packer would be the difference between total pressure in the tubing and total pressure in the casing at the particular packer. In the case of multiple packers, the pressure differential across each respective packer would be the pressure difference between total casing pressure at the lower end of the upper annulus and total casing pressure at the upper end of the lower annulus. Assuming that a conventional packer having a rubber elastomer sealing system is used, then the pressure differential would be the difference in pressure between the two sides of the set element. However, prior to setting the packer, this value would be zero, as fluids and gases may free flow around the packer seal in the well bore casing. With these considerations in mind, the pressure differential across a single packer is calculated as shown in equation (36).

$$\Delta P_p=P_{TF}-P_{CF} \quad (36)$$

For a completion system with a first packer (subscript 1) and a second packer (subscript2), the first packer pressure differential would be calculated as shown in equation (37).

$$\Delta P_{p(1)}=P_{cf(2)}-P_{CF(1)} \quad (37)$$

Similarly, for a completion system with three packers installed, the pressure differential across the upper packer would be calculated as shown in equation (37), while the pressure differential for the lower packer would be calculated through equation (36). However, the middle packer would be calculated as shown in equation (38).

$$\Delta P_{p(2)}=P_{cf(3)}-P_{CF(2)} \quad (38)$$

Although the present exemplary embodiment teaches the calculation of pressure differential across a completion system of up to three packers and three tube string sections, the present invention is not limited in application to completion systems having three packers or less. Rather, the calculation principles of the present invention may be applied to calculate forces and stresses for completion systems having any number of tube strings and/or packers, assuming that the user input specified the appropriate user information for each of the respective packers for which calculations must be undertaken.

With the packer pressure calculations complete, the only remaining pressure calculations are the change in tubing pressure at the surface, the change in casing pressure at the surface, the change in tubing pressure at the packer, and the change in casing pressure at the packer. These pressures are represented by equations (39), (40), (41), and (42), respectively.

$$\Delta P_t=P_{tf}-P_{ti} \quad (39)$$

$$\Delta P_c=P_{cf}-P_{ci} \quad (40)$$

$$\Delta P_T=P_{TF}-P_{TI} \quad (41)$$

$$\Delta P_C=P_{CF}-P_{CI} \quad (42)$$

With the pressure calculations complete, the next series of calculations relates to helical buckling effects. For example, consider a string of tubing freely suspended in the absence of any fluid inside the casing. If an upward force F is applied at the lower end of the tubing, then this force would act to compress the string. Further, if the force and resulting compression is large enough, as is often the case in oil wells, then the lower portion of the tube string will buckle into a helix. This compressive force decreases with upward distance along the tube string from the packer in the well bore, and generally becomes zero at a neutral point of the tube string. Above the neutral point, the string is in tension and remains straight, while below the neutral point the tube string is subject to buckling from the compression force.

Buckling may cause a number of parameters in the tube string to vary. One parameter varied as a result of buckling is the linear length of the tube string itself, as a buckled tube string clearly has a shorter linear length than one that is straight or true. However, the method for calculating change in length as a result of buckling varies dependent on whether the section under analysis is completely buckled or partially buckled, which may be determined through calculating the neutral point of a tube string. The neutral point of a tube string may generally be determined as shown in equation (43), wherein n represents the location of the neutral point upward in the well bore from the packer, F represents the resultant force, and W represents the weight per unit length of the tube string.

$$n = \frac{F}{W} \tag{43}$$

However, in a helical buckling analyses, F is replaced by a value commonly known as the fictitious force, as a portion of the force does not appear to exist in accordance with physics theory. The proof of this theory is covered in depth in the Appendix of the previously mentioned Lubinski paper. The actual fictitious force (Ff), which may exist under initial and final conditions, is defined as the area of the packer seal bore multiplied by the difference in pressure inside the packer and outside the packer, as shown in equation (44).

$$F_f = A_p(P_T - P_C) \tag{44}$$

This force is assumed to remain constant regardless of the number of packers or the number of tubing sections placed between the packers in the particular completion system. Therefore, the fictitious force at any point in the tube string may be calculated by subtracting the weight of the string in fluid below the point of interest from the actual fictitious force from equation (44), as shown in equation (45).

$$F_{fn} = F_f - \sum_{i=1}^{n} LW_{i+1} \tag{45}$$

Equation (45) illustrates that when the weight of the string in fluid becomes greater than the fictitious force at the packer, then the fictitious force at that point in the string becomes negative. Above this point, helical buckling would not be expected to occur, as the force is negative and actually stretching the tube string as opposed to compressing it to cause buckling. The fictitious force is calculated for each tubing section in order to determine change in length as a result of buckling. However, the fictitious force calculations for the entire tube string can also be used to confirm the calculation of the neutral point. In particular, as the calculation of the fictitious force for each tube string is executed, when the fictitious force reverses sign, that is becomes negative from positive assuming the calculations begin at the bottom of the tube string and progress upward, then the neutral point must reside within the section where the fictitious force reversed sign.

The actual calculations for the neutral point begin with calculations relative to the weight of the tube string (W), as shown in equation (46).

$$W = w_s + w_i - w_o \tag{46}$$

The variables $w_s$ (weight of the tubing in air), $w_I$ (weight of the fluid inside the tubing), and $w_o$ (weight of the fluid in the annulus) are defined in equations (47), (48), and (49), respectively, wherein $w_{tbg}$ represents the weight of the tubing.

$$w_s = \frac{w_{tbg}}{12} \tag{47}$$

$$w_i = \rho_i\left(\frac{A_i}{231}\right) \tag{48}$$

$$w_o = \rho_c\left(\frac{A_o}{231}\right) \tag{49}$$

However, in calculating weight of the fluid in the annulus ($w_o$) as indicated by equation (49), it should be noted that the calculation for $w_o$ does not include the parameter of the volume of casing fluid outside the tubing, but rather uses the volume of casing fluid displaced when tubing is inside the casing. As a result of the use of this parameter, the buoyant weight of the tubing string is accounted for in the calculation. Furthermore, under initial conditions, a low fluid level may result in the string weight inside the well being equal to the string weight in air. This possibility is addressed by the present invention in the same manner as the method for calculating the hydrostatic forces noted above.

With the intermediate values determined, e.g, the tubing weights, the calculations turn to determining the neutral point of the tube string, which was generally discussed above. The general formula for determining the neutral point is illustrated in equation (43). However, for a multi-section tube string the values for the force and weight parameters illustrated in equation (43) are substituted with the resultant fictitious force from equation (44) and the weight parameters from equations (47), (48), and (49). Substitution of these parameters yields the neutral point of the tube string, as shown in equation (50). However, application of equation (50) to determine the neutral point begins with the assumption that the neutral point is located in the lowest section of the tube string. Therefore, equation (50) is first applied to the parameters of the lowest tube string, e.g., the force and weight parameters of the lowest tube string to determine if the neutral point is located within the lowest section of the tube string.

$$n = \frac{F_f^*}{(w_s + w_i - w_o)} \tag{50}$$

Once the calculations are completed for the lowest tube section in the string, the calculated value is compared to the length of the lowest tube section. If the value is larger than the length of the tube section, then the neutral point is not located in the lowest tube section. If the calculated value is smaller than the total length of the section, then the neutral point is located at "n" units above the bottom of the section. If the value is determined not to be in the section being reviewed, then the calculations shift to the section tubing immediately above lowest section where the calculation for the neutral point is again undertaken using the parameters for the particular section. The calculation of the neutral point within the second section is shown in equation (51).

$$n = \frac{F_f^* - (L(w_s + w_i - w_o))_{bottom}}{(w_s + w_i - w_o)_{second}} + L_{bottom} \tag{51}$$

The numerator of equation (51) is a specific form of the general equation for the fictitious force at the bottom of the second string. Since the neutral point is known to be above the bottom tubing section as per equation (50), the length of the bottom section ($L_{bottom}$) is added to that portion of the string in the second section that remains buckled, which is represented by the fraction portion of equation (51). In similar fashion to the analysis of the lowest section, if n is calculated to be greater than the combined length of the bottom and second sections, then the neutral point is determined to be above the second section. Further, if n is greater than the combined lengths, then the second section is also determined to be completely buckled, in similar fashion to the lowest section. However, if the calculated value is less than the combined length of the lower and second sections, then the neutral point is determined to be "n" units above the bottom of the second string.

If the neutral point is not found in either the first or second sections, then the calculations move up to the third section in the tube string in search of the neutral point. I moving to the third section, equation (52) is applied. If equation (52) determines that the neutral point is above all three tube sections, then the neutral point is above the surface of the well (or at least above the top of the third tube string), and therefore, the entire tube string is completely buckled.

$$n = \frac{F_f^* - (L(w_s + w_i - w_o))_{second} - (L(w_s + w_i - w_o))_{bottom}}{(w_s + w_i - w_o)_{top}} + L_{second} + L_{bottom} \tag{52}$$

With the neutral point determined, the next series of calculations functions to determine the length change of the entire tube string as a result of helical buckling characteristics. The determination of the neutral point is critical to this series of calculations, as a partially buckled string is completely distinct from the fully buckled string for purposes of calculating length change. For example, if the neutral point is determined to be within the second tube section, the equation for determining the change in length in the second string as a result of buckling is shown in equation (53).

$$\Delta L_2 = -\frac{r^2 F_f^2}{8EIW} \tag{53}$$

However, the total length change of the tube string is not represented by the solution to equation (53) alone, as the length change resulting from the buckling of the lower tube section is not considered in equation (53). Therefore, in order to determine the total length change of the completion system tube string, the length change of any tube sections below the second tube section must be calculated. As such, the length change of the lower tube section must be determined, as shown in equation (54).

$$\Delta L_2' = -\left[\frac{r^2 F_f^2}{8EIW}\right]\left[\frac{LW}{F_f}\left(2 - \frac{LW}{F_f}\right)\right] \tag{54}$$

Upon calculating the change in length of the lower section in accordance with equation (54), the length change of the lower section is added to the second section to yield the length change for the entire tube string. Using this process, the length change for any tube string may be calculated, as equation (53) may be used to determine the change in length in the tube section having the neutral point therein, while equation (54) may be used to determine the change in length in any other tube sections below section having the neutral point therein. These values may be summed to determine the actual change in length of a tube string as a result of helical buckling characteristics. Since the tubes section(s) above the section having the neutral point therein are not in a partially or fully buckled state, these sections do not change in length for purposes of helical buckling calculations and are therefore not considered.

However, returning to the location of the neutral point, if the neutral point is determined to be relatively close to the top or bottom of a tube section in a complex system, conventional calculations may generate in an erroneous answer, e.g., a positive length change resulting from buckling. The present invention avoids this inaccuracy be analyzing the terms contributing to the buckling calculations. For example, the present invention may analyze the last term $$2 - \frac{LW}{F_f}$$

in equation (54) to determine if this term is less than or equal to zero. If the term is found to be less than zero, which indicates that an erroneous result will be generated, then the present invention may utilize equation (53) to determine the change in length, thus avoiding the inaccurate contribution from equation (54). Alternatively, if, for example, the neutral point is determined to be below an upper end of a tube section, but relatively close thereto, then the "completely buckled" equation should be applied, as opposed to the "partially buckled" equation, as the tube string most resembles a completely buckled tube section when the neutral point is determined to be relatively close to the upper tube end. Therefore, the calculation procedure for the present invention may alternatively be configured to determine if the neutral point is within a predetermined length of an end of the tube section under analysis. If the calculated neutral point is determined to be close to the end of the tube section, as per the predetermined length parameter, then the analysis may recalculate buckling characteristics for the tube section having the neutral point therein with the appropriate equation. The predetermined length parameter may be selected through analysis of the physical characteristics of the tubing being analyzed such that the proper predetermined length may be determined for producing accurate results in the helical buckling length change calculations. However, in either case, the final result should not include positive length change as a result of improperly calculated buckling characteristics.

Additional calculations relative to helical buckling include calculating pitch related parameters of the tube string. In particular, the pitch of the helix under initial conditions is calculated as shown in equation (55).

$$P_{bi} = \pi\sqrt{\frac{8EI}{F_{so}}} \div 12 \tag{55}$$

In this equation, when the slackoff force ($F_{so}$) is less than or equal to zero, then there is no helix. Equation (56) illustrates the pitch of a helix under final conditions.

$$P_{bf} = \pi\sqrt{\frac{8EI}{F_f^*}} \div 12 \tag{56}$$

Similarly, when the resultant fictitious force ($F_f^*$) is less than or equal to zero in equation (56), there again is no helix. As such, the resultant fictitious force is then added to the packer restraining force. Equations (55) and (56) are applied to each section of the tubes string to determine the pitch for each of the respective section. Aside from the pitch, the helix angle under initial and final conditions is determined through equations (57) and (58), respectively.

$$\phi_i = \mathrm{TAN}^{-1}\left[2\pi\frac{(ID_c - OD_t)}{24P_{bi}}\right] \tag{57}$$

$$\phi_f = \mathrm{TAN}^{-1}\left[2\pi\frac{(ID_c - OD_t)}{24P_{bf}}\right] \tag{58}$$

The next series of calculations are related to the weight of the tube string. String weight is generally a value that would be read on a scale attached to the top of a tubing string when the tube string is suspended in air below the scale. There are two common references to string weight: weight in air and weight in liquid. Tube string weight in air is the weight of the tubing string if it were suspended in a well bore with no fluid inside and without contact with the outer wall or casing of the well. Calculation of string weight in air is represented by equation (59), wherein the tubing weight is input in units of pounds per foot.

$$W_{air}=w_sL \tag{59}$$

Alternatively, the weight of the tube string in liquid is the measured weight of the tubing string if it were suspended in a well bore that was partially or completely filled with a liquid. There are two common methods of calculating this value. The first is to assume that the density of steel is 65 pounds per gallon. Then the string weight in air is divided by 65 to get the number of gallons of casing fluid displaced. Since the casing fluid density is generally known, the number of "gallons of steer" may be multiplied by the casing fluid density to get the buoyant force. Then the buoyant force, which was calculated above, may be subtracted from the string weight in air to get the string weight in liquid. The second method considers the density of the fluid inside the tubing. The theory is that fluid inside the tubing affects the hook load. For example, consider the case of 7⅝" tubing inside 9⅝" casing; leave the 7⅝" casing empty (filled with air) with a plug on bottom and run in the hole. There will be a depth at which the 7⅝" is weightless (floats) even though the weight of the tubing displaces only a small amount of casing fluid. This is how casing float equipment works. The present invention uses this logic and determines that the weight of the string in liquid, as shown in equation (60).

$$W_{liq}=L(w_s+w_i-w_o) \tag{60}$$

With the weights calculated, the analysis of the tube string turns to the calculation of the actual forces acting on the tube string. An actual force exists on the steel and elastomer cross section of the tubing at the packer. This actual force is represented by equation (61), which my be either a positive or negative force.

$$F_a=(A_p-A_i)P_{TBG}-(A_p-A_o)P_{CSG} \tag{61}$$

The actual force at any point in the tube string may be determined by subtracting the weight of the tube string in air below the point on interest from the actual force of equation (61). In combination strings, if the tubing ID or OD changes, a concentrated force is introduced at the transition point due to fluid pressure. This concentrated force is added to the actual force at the bottom of the string to obtain the actual force at the bottom of the section, as shown in equation (62).

$$F_{a1}'=(A_{i2}-A_{i1})P_{TBG1}-(A_{o2}-A_{o1})P_{CSG1} \tag{62}$$

For a three section tube string with tubing dimension changes at the transitions and an absolute pressure differential across the tubing wall, equation (63) represents the actual force on the tube string.

$$F_{a1}=F_{a1}'+F_{a2}'+F_a-(Lw_s)_2-(Lw_s)_3 \tag{63}$$

Equation (63) illustrates the actual force at the upper transition between sections 1 and 2 by summing the concentrated force at that transition, the concentrated force at a second transition (between section 2 and section 3), and the actual force where section 3 is sealed in the packer, and subtracts the weight in air of tubing sections two and three. In determining the actual force values, the present invention may utilize a matrix calculations for the values for $F_a'$, assuming the transition between sections 1 and 2 and 2 and 3 are intermediate points in the string and that the bottom section does not terminate in a packer For the transition areas, changes in tubing inside area and changes in tubing outside area may also be calculated. The total pressure in the annulus may then be multiplied by the change in tubing outside area, and the change in the total tubing pressure may be multiplied by the change in tubing inside area. These two values may be summed to obtain the total force for that section. Alternatively, a second matrix may be generated and determined under the assumption that each tube section in the tubing terminates into a packer, wherein the appropriate tubing diameter in conjunction with packer seal bore diameter are used to determine $F_a$. A third matrix may be used to calculate $F_a$ at transitions using the general form of the equation, assuming the three possible cases of one, two and three tubing sections. Further, each of the above noted force calculations are completed for both initial and final conditions.

The next series of calculations is directed towards determining the change in length of the tube string due to piston or compressive effects. In accordance with Hooke's Law, a piston effect generally results in shortening of a tube section as a result of the hydraulic forces acting on the tubing. These forces result from differences in total pressure and/or differences in area upon which total pressure acts. Piston force calculations are generally determined through the actual force exerted on the tubing, as discussed and/or calculated above. Therefore, in order to obtain a tube string length change, the change in actual force at each tube section transition must be first be calculated for each section. The calculation for an individual section is shown in equation (64).

$$\Delta F_a=F_{af}-F_{ai} \tag{64}$$

This change in force is transformed in change in length using Hooke's Law and the assumption that tubing material remains elastic under the results of this analysis/calculation. The length changes for each section are summed to obtain total length change for the string, wherein the length change for a single section are calculated through equation (65).

$$\Delta L_1 = \frac{L}{EA_s}\Delta F_a \tag{65}$$

Once the change in length for each section of the tube string is calculated, the results are summed to determine the total length change of the tube string resulting from piston effects.

In similar fashion to the calculations for the piston effect, the ballooning effect also alters the overall length of the tube string, and therefore should be considered in the total length calculations relating to the tube string. The ballooning effect is generally defined as the situation when changes in pressure result in changes in radial force on tube section. An increase in internal tubing pressure generally increases the diameter of the tubing and decreases the length of the tubing. Since the tubing simply increases in diameter, the effect has been generally termed ballooning. However, the formulae for the calculation of length change due to ballooning are far from simple. As such, conducting intermediate calculations generally operates to substantially reduce calculation process. Three initial parameters may be calculated prior to conducting the ballooning calculations.

First, the change in tubing fluid density may be calculated, as shown in equation (66).

$$\Delta\rho_{t(n)} = \frac{0.052(\rho_{tf(n)} - \rho_{ti})}{12} \tag{66}$$

Next the change in casing fluid density may be calculated, as shown in equation (67).

$$\Delta\rho_{c(n)} = \frac{0.052(\rho_{cf(n)} - \rho_{ci})}{12} \tag{67}$$

Finally, a dimensionless tubing constant may be calculated, wherein the constant is represented by equation (68).

$$R = \frac{OD_{t(n)}}{ID_{t(n)}} \tag{68}$$

With these initial calculations complete, the actual calculation of the ballooning effect may be undertaken. However, the ballooning effect generally includes two distinct terms: first, a term representing a density change effect; and second, a term representing pressure change effect. The first term may be calculated as shown in equation (69), while the second term may be calculated as shown in equation (70).

$$T_{1(n)} = -\left[\frac{\mu L^2}{E}\right]\left[\frac{\Delta\rho_{t(n)} - R^2\Delta\rho_{c(n)}}{R^2 - 1}\right] \tag{69}$$

$$T_{2(n)} = -\left[\frac{2\mu L}{E}\right]\left[\frac{\Delta P_{t(n)} - R^2\Delta P_{c(n)}}{R^2 - 1}\right] \tag{70}$$

The total effect as a result of the ballooning effect for a single tube section is the sum of the results from equations (69) and (70), as shown in equation (71), which yields the length change of a particular section of tubing (n) as a result of ballooning effects.

$$\Delta L_{3(n)} = T_{1(n)} + T_{2(n)} \tag{71}$$

However, the present invention teaches away from that which is commonly accepted in the art with respect to calculating the total change in length of a tube string from the ballooning effect. In particular, the procedure in Hammerlindl's paper teaches to sum the individual sections to determine the total length change as a result of the ballooning effect, however, as noted in the background section, this calculation technique may yield an incorrect result. The present invention avoids potential errors in Hammerlindl's calculation by teaching away from the accepted principle espoused by Hammerlindl.

The next series of calculations are generally related to determining the slackoff force in the tube string. Slackoff force is generally applied to the tube string from the surface via a mechanical apparatus. Assuming the sign convention to be positive/negative along the axis of the tube string, wherein a positive force is defined as a downward force from the surface, slackoff forces may be either positive, when weight is slacked off of the tube string, or negative, when weight is picked up off of the tube string. A more complete discussion of slackoff forces is given in SPE paper #26511, which is incorporated by reference herein. The calculation of slackoff force reaching the packer is shown by equation (72), wherein the constant $K_n$ is calculated according to equation (73) for each tubing section.

$$F_{soP} = \left(\frac{w_{s(n)}}{K_{(n)}}\right)^{0.5} \mathrm{TANH}\left[\left(\frac{K_{(n)}}{w_{s(n)}}\right)^{0.5} F_{so}\right] \tag{72}$$

$$K_n = \frac{r_n\mu}{4EI_n} \tag{73}$$

Inasmuch as the value for slackoff force is generally calculated for each section of the tube string, the slackoff force for the entire tube string may be calculated by summing the forces for the individual sections using a weighted average technique. Once slackoff force is determined, the affects of this force must also be determined. In particular, slackoff force is known to add length to the tube string, and therefore, a determination of a positive value for the slackoff force in equation (72) indicates a positive length change in the tube string. However, there are two terms that determine the slackoff length change: first, a term representing the pure elastic length change according to Hooke's Law; and second a term representing the effects of buckling inside the casing. Equation (74) represents the pure elastic length change term and equation (75) represents the buckling term.

$$T_{so1} = \frac{F_{so}L_{(n)}}{A_{s(n)}E} \tag{74}$$

$$T_{so2} = \left[\frac{r_{(n)}^2 F_{so}^2}{8EI_{(n)}(w_s + w_i - w_o)_{(n)}}\right] \tag{75}$$

The total slackoff force is the combination of the equations (74) and (75). For multiple tube sections the pure elastic change term is summed and the buckling term is added one time using a weighted average. However, although equations (74) and (75) are published and generally accepted in the industry, these equations are independent of length. Therefore, the implication is that slacking off weight 10,000 feet or one inch would yield identical force reaching the packer, which is inaccurate for field application purposes. Therefore, in similar fashion to the neutral point and buckling calculations discussed above, the slackoff force may be compared to a predetermined range in order to determine if the force is within the range of forces likely to generate an impractical result. If the forces are within this range, the method of the present invention may be configured to execute alternate calculations for slackoff force designed to generate a practical result under the particular conditions for which the generally accepted equations are not applicable. For example, since the slackoff force reaching the packer is independent of length, values for the constant and the calculated force from equations (74) and (75) are calculated for each section based on tubing and casing properties. The buckling term is also calculated for each section. A weighted average of the slackoff force and the buckling term are calculated for the three tubing sections, as shown in equation (76).

$$F_{so} = \frac{F_{so1}L_1 + F_{so2}L_2 + F_{so3}L_3}{L_1 + L_2 + L_3} \tag{76}$$

The calculation for two tubing sections is shown in equation (77).

$$F_{so} = \frac{F_{so1}L_1 + F_{so2}L_2}{L_1 + L_2} \tag{77}$$

If the completion system is operating in the elastic range for the tube sections, then Hooke's Law states that the previously calculated length changes may be converted into force changes in the tube string. To accomplish this, section properties are normalized over the tube string length. The calculation for the conversion from length to force is shown in equation (78).

$$\Delta F = \Delta L\left(\frac{A_s E}{L}\right) \tag{78}$$

Since tubing sections may have different lengths and cross sectional areas, and tube length changes are calculated for an entire tube string. As such, the weighted average of the tubing properties for a three-section tube string are shown in equation (79).

$$\frac{A_s}{L} = \frac{L_1 A_{s1} + L_2 A_{s2} + L_3 A_{s3}}{(L_1 + L_2 + L_3)^2} \tag{79}$$

For a two-section tube string equation (80) illustrates the weighted average.

$$\frac{A_s}{L} = \frac{L_1 A_{s1} + L_2 A_{s2}}{(L_1 + L_2)^2} \tag{80}$$

In order to convert the length change into the force change, the normalized section property factor from either equation (79) or equation (80) is multiplied by the length change and modules as shown in equation (81).

$$\Delta F_{1-4} = \Delta L_{1-4} E\left(\frac{A_s}{L}\right)_{normalized} \tag{81}$$

Normalization of tube section properties has generally been ignored by traditional completion system analysis techniques. This fact has generally not affected the calculation outcome of previous methods for analyzing completion systems, as the tube sections in completion systems of the past were generally assumed to have no significant difference in physical characteristics. However, application of this assumption to present completion systems often yields an inaccurate and misleading completion system analysis, as tube sections of various physical characteristics are often implemented in single completion system. In response to this incorrect assumption of traditional analysis systems, the present invention includes the normalization technique, which directly accounts for variances in the physical characteristics of the tube sections. Therefore, the method of analysis of the present invention will generate an accurate analysis of a completion system in situations where previous systems will fail.

In addition to the slackoff forces, the forces exerted upon the various packers are also of concern in the analysis of a completion system. In particular, the bottom of the tube string exerts a force on the packer that is dependent upon the direction of the force and the type of packer seal assembly used. For example, packers that permit free motion, termed type 1 packers herein, generally sustain no tubing to packer force, other than the theoretical seal friction forces that are minimal for purposes of the completion system analysis. In type 1 packers free motion tubing is free to move longitudinally within the well casing over the complete calculated length change distance. Packers that permit limited motion, termed type 2 or landed packers herein, are capable of sustaining a compressive or positive packer to tubing force. The resultant tensile force is generally shown as a zero tubing to packer load, and in effect, involves some upward seal movement. Packers that permit no motion of the tube string, termed type 3 or anchored packers herein, are capable of sustaining tensile or compressive loads applied by the tubing and generally permit very little seal movement. In using type three packers, care must be taken with the shear release anchor seal assemblies to assure a net tensile load will not be sufficient to release the seals and cause system failure. In order to calculate and/or evaluate the tubing to packer forces, the present invention may utilize a matrix operation having conditional branches for verification of packer type and load carrying capability. The following chart is an example of the formulae and conditions applied to determine tubing to packer force.

| Packer Type | Initial Condition | Final Condition |
|---|---|---|
| Type 1 Packer | 0 | 0 |
| Type 2 packer | $\Sigma F_{1-5}$ | $F_{SO}$ |
| Type 3 Packer | $\Sigma F_{1-5}$ | $F_{SO}$ |

However, the initial and final conditions for the type 2 packer assumes that the summation of the forces 1–5 and Fso are greater than zero, as otherwise the force on the tubing to packer would be zero.

Another force related parameter to be calculated in analyzing a completion string is the top joint tension. The accepted formula for calculating the tensile force in the top joint is shown in equation (82).

$$F_{tj} = W_s - F_a - F_p \tag{82}$$

For this calculation, Fp has been modified to include the full value of slackoff force. Even though only a portion of the slackoff force reaches the packer, all of the slackoff force is applied to the top joint. Normally, Fp would be the amount of tubing to packer force. It should be noted that the top joint tension equation generally requires using the weight of the tube string in air less the calculated packer to tubing force, less the calculated actual force from pressure. Since tube strings are seldom evaluated in air, the analysis may consider the weight of the string in liquid, assuming that an appropriate correction factor is implemented to reflect the difference in the two weights, if desired by the user. Therefore, use of equation (82) without a correction factor presents a conservative approach to evaluating and/or calculating the top joint tension.

The top joint tension force gives rise to a top joint stress parameter, which may be calculated for both initial and final conditions. The top joint stress is calculated in accordance with equation (83).

$$\sigma_{tj} = \frac{F_{tj}}{A_{stj}} \tag{83}$$

Another force present in the tube string is the normal axial stress, which also must be calculated in order to accurately analyze a completion system. The normal axial stress in a tube string is generally due to the actual axial force $F_{af}$ in conjunction with tubing to packer forces $F_p$ acting on the tubing cross sectional area. To calculate this stress, the resultant actual tubing force Fa* is calculated for each tubing section, as shown in equation (84).

$$F_a^* = F_a + F_p \tag{84}$$

The resultant actual force is calculated for both initial and final conditions using the $F_p$ along with the $F_a$ calculated in equation (84), based on packer type and the determined summation of forces at the packer using the slackoff weight at the packer. Slackoff weight at the packer is used as opposed to the full slackoff weight, as the result of the normal axial stress calculation is used as a component in the corkscrew stress formula. Since corkscrew stress is generally greatest where helical buckling is greatest, e.g., at the packer, this value may be judged to be most representative. Having calculated the resultant axial force, the normal axial stress in each section may be calculated as shown in equations (85) and (86).

$$\sigma_{ai} = \frac{F_{ai}^*}{A_s} \tag{85}$$

$$\sigma_{af} = \frac{F_{af}^*}{A_s} \tag{86}$$

The next series of calculations in the analysis of a completion system are related to the tube bending stress calculations. A bending force for a tube section under initial conditions may be calculated as shown in equation (87), while the same calculation for final calculations may be calculated as shown in equation (88).

$$F_{bi} = F_{ai} + (A_i P_{TI}) - (A_o P_{CI}) \tag{87}$$

$$F_{bf} = F_{af} + (A_i P_{TF}) - (A_o P_{CF}) \tag{88}$$

Calculation of the values in equation (87) and (88) generally require consideration of the packer restraint forces for landed and anchored tubing situations. If either F*bi or F*bf returns values less than or equal to zero, then their value is set at zero. As such, bending exists only if the bending force is greater than zero. Therefore, bending stress under initial conditions is calculated as shown in equation (89), and bending stress under final conditions is calculated as shown in equation (90).

$$\sigma_{bi} = \frac{OD_t r F_{bi}^*}{4I} \tag{89}$$

-continued $$\sigma_{bf} = \frac{OD_t r F_{bf}^*}{4I} \tag{90}$$

With the axial and bending stress values calculated, common practice is to apply the maximum distortion-energy theory for calculating tri-axial stresses in the tubulars. Equation (91) illustrates the general formula for calculation of the outer fiber stress, and equation (92) illustrates the general formula for calculation of the inner fiber stress, as generally presented by Lubinski.

$$\sigma_o = \sqrt{3\left[\frac{P_T - P_C}{R^2 - 1}\right]^2 + \left[\frac{P_T - R^2 P_c}{R^2 - 1} + \sigma_a \pm \sigma_b\right]^2} \tag{91}$$

$$\sigma_i = \sqrt{3\left[\frac{R^2(P_T - P_C)}{R^2 - 1}\right]^2 + \left[\frac{P_T - R^2 P_c}{R^2 - 1} + \sigma_a \pm \frac{\sigma_b}{R}\right]^2} \tag{92}$$

Where initial and final values are substituted into equation (91) and (92), the resultant calculation represents the stress relative to the respective input parameter. Since both equations include a i b term, stress is calculated once by adding a bending stress and once by subtracting a bending stress, as the above compilation of equations dictate. As such, the maximum value for the stress is calculated as the total stress. The axial stress tends to be uniform over the cross-section, while the bending stress tends to be higher at the outer wall and stress due to pressure greater at the inner wall. If both axial and bending stresses remain less than the yield strength of the tubing, theory states that the tubing will not be permanently corkscrewed.

Another parameter, which is again related to the force or stress calculations, is the calculation of the longest wireline tool that may be passed through the tube string. In tube sections where the net tubing force is in tension, there is no helix effect, and therefore no limit on the length of wireline tool that will pass. Where tubing force is compressive, then there is assumed to be a helix that prevents and infinite length tool from being passed through the tubing as a result of the geometric restraints created inside the tube string as a result of the helix condition. Therefore, in order to determine the longest wireline tool that may be passed, the force must first be determined. This force is calculated as shown in equation (93).

$$F = F_a^* + (A_i P_T - A_o P_C) \tag{93}$$

The value calculated in equation (93) is then substituted into equation (94) to determine the longest length of a tool that may be passed through a tube subject to a helix effect, wherein the calculation of equation (94) is undertaken at both initial and final conditions.

$$L_{wt} = 4\sqrt{\frac{EI(ID_t - OD_{wt})}{F\left(\frac{ID_c - OD_t}{2}\right)}} \tag{94}$$

Another parameter calculated in the completion system evaluation and analysis of the present invention is the state of stress in the tubing, as it is generally prudent to review all stress values calculated to determine the cause of the highest stress in the string. The general values compared are shown in equation (95).

$$\sigma_p = \frac{(P_T - P_C)OD_t}{0.875(OD_t - ID_t)} \quad (95)$$

Figure 4:
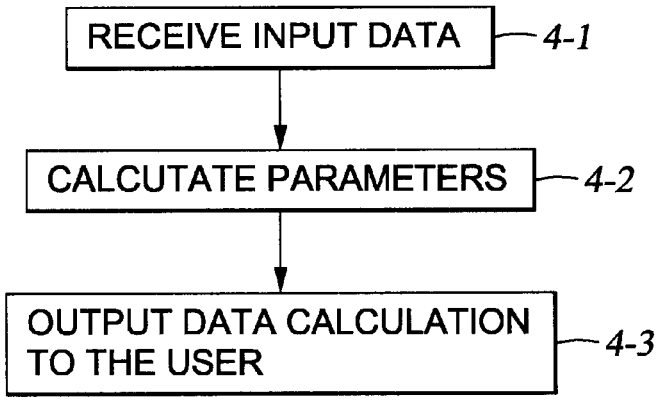
FIG. 4 illustrates an exemplary method of the present invention.

The compilation of equations (2) through (95) illustrate the mathematical foundations supporting the method of analysis of the present invention. However, in operation, an exemplary method of the present invention may be summarized as shown in FIG. 4. At step 4-1 the exemplary method of the present invention receives input data generally representative of the physical characteristics of the completion system to be analyzed. These physical characteristics, examples of which are listed above, may include the diameter of tubing used in the tube string, the length of the tube string, pressures and densities of fluids in the well bore and/or tube string, forces applied to the tube string, and the quantity an and type of tube sections and packers utilized by the completion system. These input parameters are transmitted to a processing device where the calculations evidenced in equations (2) through (95) may be undertaken at step 4-2. Selected portions of the calculations from equations (2) through (95) may then be outputted to the user through an output device at step 4-3. Step 4-2, the calculation step, includes both primary and intermediate calculations. Primary calculations generally represent those calculations that are directly relevant to the analysis of the completion system, and intermediate calculations generally represent those calculations that are necessary to complete the primary calculations.

One aspect of the calculation step illustrated in FIG. 4 is the calculation of the change in length of the tube string of the completion system. In order to determine the total change in length of the tube string, numerous parameters must be considered for each section of tubing in the tube string. As noted above, although summation principles apply to some calculations relative to change in length, careful analysis of the parameters and applicable equations is necessary in order to determine when summation may be applied in order to generate an accurate result.

Figure 5:
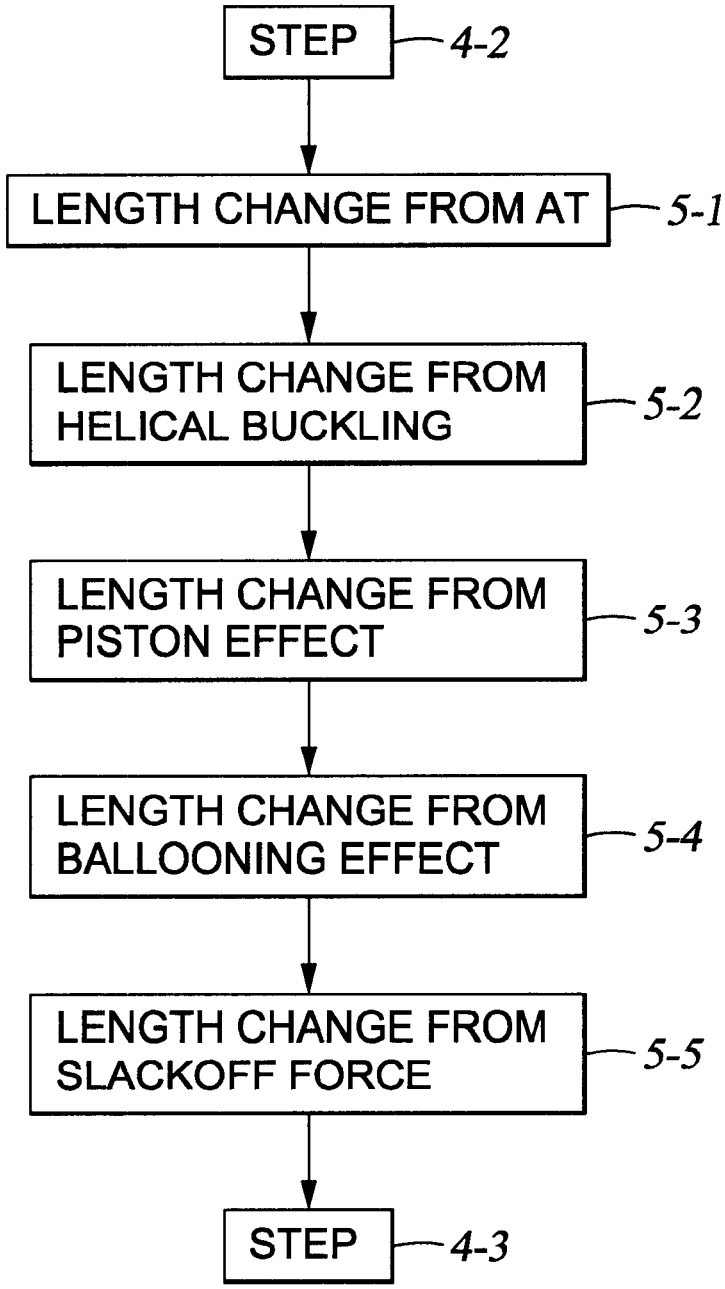
FIG. 5 illustrates an example of calculations under taken at step 4–2 in FIG. 4.

FIG. 5 illustrates parameters that may be calculated in the present invention in order to determine the total change in length of the tube string. A first parameter the may be calculated is the change in length of the tube string as a result of linear expansion of the individual tube sections as a result of a temperature gradient, which is shown as step 5-1. This calculation, which is discussed above with respect to equations (2) through (22), involves determining the amount that each tube section will linearly expand for every degree of temperature rise in the well bore. The calculations of step 5-1 are therefore primarily dependent upon the temperature gradient in the well bore and the physical characteristics of the material used to manufacture the tube sections, which is reflected in the coefficient of linear expansion ($\alpha$ in equation (22)). The calculations shown in equations (2) through (22) allow for various tube sections having different physical characteristics, e.g., inside and/or outside diameter, tube section composition, and section length. The final change in length of an individual tube section as a result of the temperature gradient is shown in equation (22) as $\Delta L_4$, which must be calculated for each section of tubing in the tube string.

Another parameter that may be calculated is the change in length of the tube string as a result of helical buckling of the string in the well bore, as shown in step 5-2. Equations (43) through (54) generally represent the calculations necessary to determine the change in length of the tube string as a result of helical buckling. However, helical buckling is dependent upon pressures in the tube string and the well casing, and therefore, the calculation of equations (43) through (54) may incorporate the pressure parameters calculated in equations (23) through (42). Further, buckling in a tube string occurs in one of two conditions: first, partially buckled; and second, completely buckled. Therefore, prior to calculating the change in length of a tube section as a result of buckling characteristics, first the condition of the section must be determined in order to determine whether to calculate under either partially or completely buckled parameters. In order to determine the condition of the respective tube section, the neutral point of the tube string is first determined, as shown in equations (43) through (52). Thereafter, each tube section below the section having the neutral point therein is determined to be completely buckled, while the section having the neutral point therein is determined to be partially buckled. As such, the calculation for the change in length of the completely buckled tube sections is accomplished as illustrated in equation (54), while the partially buckled section is calculated as shown in equation (53). However, as noted above, if the neutral point is determined to be relatively close to the end of a tube string, then the tube string having the neutral point therein may be treated as being completely buckled in order to generate a more accurate result, as discussed above. The total change in length resulting from helical buckling is generally the sum of the calculations for the individual tube sections represented by $\Delta L_2$ in equations (53) and (54).

Another parameter that contributes to determining the total change in length of the tube string is the piston effect, which is shown in step 5-3. The change in length as a result of the piston effect ($\Delta L_1$) is calculated for each section of the tube string in equation (65). However, since the piston effect is directly dependent upon the forces acting upon each individual tube section, equations (59) through (64) are generally calculated for each tube section prior to determining the change in tube length as a result of the piston effect in equation (65). Once the change in length for each tube section as a result of the piston effect has been calculated, then the total change in length of the tube string from the piston effect may be found by summing the length changes for the individual tube sections.

Another parameter contributing to the change in length of the tube string is the ballooning effect, which is shown as step 5-4 in FIG. 5. The ballooning effect results from pressure being exerted on the inner walls of the tube sections, and possibly from the pressure differential between the volume inside the tube string and the volume surrounding the tube string in the well casing. Another factor contributing to the ballooning effect is the differential in fluid densities inside the tube string and outside the tube string. These factors are calculated in equations (66) through (70). The forces exerted on the tube sections from the pressure and density differentials causes an increase in diameter of a tube section, and therefore, increases the length of the tube section. Therefore, the total change in length of a tube section is shown as $\Delta L_3$ in equation (71), which includes both a pressure term from equation (70) and a density term from equation (69). The total change is illustrated in equation (71) as the sum of the pressure and density terms. However, this total change is for a singular tube section, as summation principles are not applicable to the ballooning principle as a result of the second order terms in equations (69) and (70).

Another parameter contributing to the change in length of the tube string is the slackoff force, which is calculated at step 5-5. The slack off force, which includes two contributing terms, is calculated in equations (73) through (77). The first term contributing to the slackoff force is shown in equation (74) and represents a pure elastic change in the tube section. The second term is shown in equation (75) and represents a buckling term. The total slackoff force is calculated by summing the individual forces calculated for each tube section. Once the slackoff force is determined, equations (78) through (81) may be used to determine the change in length of the tube string as a result of the slack off forces, which is represented by $\Delta L_5$.

Another parameter that is generally unrelated to the change in length of the tube string is the longest wireline tool that may be passed through the tube string in view of the various physical parameters acting upon the tube string to distort its geometry. This parameter is important to the operation of the completion system, as in the situation where a tube string is subject to tension and/or helix-type conditions, then the geometry of the inner wall of the tube string may be altered to the point where specific tools used in the completion system cannot physically pass through the helical string. Therefore, it is important to determine the longest tool that may be passed through the tube string, which is calculated as shown in equation (94). Equation (94) is dependent upon the inside and outside diameter of the tubing, as well as the forces applied to the tubing, as shown in the equation. If the string is in tension, it is generally assumed that a helical condition does not exist, and therefore, equation (94) need not be solved.

Another parameter that is valuable to determine in an analysis of a completion system is the maximum stress on the tube string. Maximum stress may result from pressure, weight, forces, and other parameters. If the stress results from pressure, as is often the case with wells, then the maximum stress may be calculated as shown in equation (95). This stress calculation may be compared to a predetermined maximum allowable stress in the system. If the predetermined stress is exceeded, then the system is generally reconfigured in some way to reduce the stress in the system to an acceptable level.

While the foregoing detailed description is directed to the preferred embodiments of the present invention, other and further embodiments of the invention may be devised without departing from the true scope of the invention. Therefore, in order to determine the scope of the present invention, reference should be made to the following claims.

What is claimed is:

1. A method for analysing a well completion system, the method comprising the steps of:

receiving data representative of physical characteristics of the completion system;

calculating a first change in length of a tube string resulting from a helical buckling effect, wherein calculating the first change in length comprises:

determining a location of a neutral point in the tube string; and selecting one of a partially buckled change in length equation and a completely buckled change in length equation in accordance with the determined location of the neutral point to calculate the first change in length;

calculating a second change in length of the tube string resulting from a ballooning effect;

calculating a third change in length of the tube string resulting from a slackoff force effect; and outputting predetermined results from the calculating steps.

2. The method of claim 1, the method further comprising the steps of:

calculating a fourth change in length resulting from a temperature gradient; and calculating a fifth change in length resulting from a piston effect.

3. The method of claim 1, wherein calculating the first change in length further comprises the steps of:

calculating a change in length resulting from helical buckling for each tube section in the tube string;

summing the calculated change in length resulting from helical buckling for each tube section in the tube string to generate the first change in length of the tube string resulting from the helical buckling effect.

4. The method of claim 3, wherein the step of calculating a change in length resulting from helical buckling further comprises the steps of:

determining a tube section having a neutral point therein;

calculating a change in length due to partial helical buckling for the tube section having the neutral point therein; and calculating a change in length due to complete helical buckling for each tube section positioned below the tube section having the neutral point therein.

5. The method of claim 1, wherein the step of calculating a second change in length further comprises the steps of:

calculating a density change effect term for a tube section in the tube string;

calculating a pressure change effect term for the tube section in the tube string;

summing the density change effect term and the pressure change effect term to determine a change in length for the tube section resulting from ballooning effects; and summing a change in length resulting from the ballooning effect for each tube section in the tube string to determine the second change in length of the tube string resulting from the ballooning effect.

6. The method of claim 1, wherein the step of calculating the third change in length further comprises the steps of:

calculating a pure elastic term for a tube section in the tube string;

calculating a buckling term for the tube section in the tube string;

summing the pure elastic term and the buckling term to determine a change in length for the tube section resulting from the slackoff force effect; and summing a change in length resulting from slackoff force for each tube section in the tube string to determine the third change in length of the tube string resulting from the slackoff force effect.

7. The method of claim 2, wherein the step of calculating a fourth change in length further comprises the steps of:

calculating a change in length due to temperature gradient for each tube section in the tube string; and summing the calculated change in length for each tube section to generate the fourth change in length resulting from temperature gradient.

8. The method of claim 2, wherein the step of calculating a fifth change in length further comprises the steps of:

calculating a change in length due to piston effect for each tube section in the tube string; and summing the calculated change in length for each tube section to generate the fifth change in length resulting from the piston effect.

9. The method of claim 1, wherein the method further comprises the step of calculating a longest wireline tool to pass through the tube string.

10. A method for analysing a string of tubulars in a wellbore, comprising:

calculating a first change in length of a section of a tube string resulting from a helical buckling effect, wherein calculating the first change in length comprises:

determining a location of a neutral point in a tube string section; and selecting one of a partially buckled change in length equation and a completely buckled change in length equation in accordance with the determined location of the neutral point to calculate the first change in length; and summing calculated changes in lengths for each tube string section to determine a total change in length as a result of helical buckling.

11. The method of claim 10, further comprising:

calculating a second change in length of the tube string resulting from a ballooning effect; and calculating a third change in length of the tube string resulting from a slackoff force effect.

12. The method of claim 10, further comprising:

calculating a fourth change in length resulting from a temperature gradient; and calculating a fifth change in length resulting from a piston effect.

13. The method of claim 10, wherein calculating the first change in length further comprises:

calculating a change in length resulting from helical buckling for each tube section in the tube string;

summing the calculated change in length resulting from helical buckling for each tube section in the tube string to generate the first change in length of the tube string resulting from the helical buckling effect.

14. The method of claim 10, wherein of calculating the first change in length resulting from helical buckling further comprises:

determining a tube section having a neutral point therein;

calculating a change in length due to partial helical buckling for the tube section having the neutral point therein; and calculating a change in length due to complete helical buckling for each tube section positioned below the tube section having the neutral point therein.

15. The method of claim 11, wherein calculating a second change in length further comprises the steps of:

calculating a density change effect term for a tube section in the tube string;

calculating a pressure change effect term for the tube section in the tube string;

summing the density change effect term and the pressure change effect term to determine a change in length for the tube section resulting from ballooning effects; and summing a change in length resulting from the ballooning effect for each tube section in the tube string to determine the second change in length of the tube string resulting from the ballooning effect.

16. The method of claim 11, wherein calculating the third change in length further comprises the steps of:

calculating a pure elastic term for a tube section in the tube string;

calculating a buckling term for the tube section in the tube string;

summing the pure elastic term and the buckling term to determine a change in length for the tube section resulting from the slackoff force effect; and summing a change in length resulting from slackoff force for each tube section in the tube string to determine the third change in length of the tube string resulting from the slackoff force effect.

* * * * *